US008071880B2

(12) United States Patent
Groegl et al.

(10) Patent No.: US 8,071,880 B2
(45) Date of Patent: Dec. 6, 2011

(54) FLEXIBLE ELECTRIC LINE

(75) Inventors: Ferdinand Groegl, Nuremberg (DE); Thomas Mann, Weissenohe (DE); Dipl.-Ing. Angela Brutler, Hiltpoltstein (DE)

(73) Assignee: Nexans, Paris (FR)

( * ) Notice: Subject to any disclaimer, the term of this patent is extended or adjusted under 35 U.S.C. 154(b) by 537 days.

(21) Appl. No.: 12/228,673

(22) Filed: Aug. 14, 2008

(65) Prior Publication Data

US 2009/0056974 A1 Mar. 5, 2009

(30) Foreign Application Priority Data

Aug. 31, 2007 (DE) ..... 20 2007 012 165 U

(51) Int. Cl.
*H01B 7/00* (2006.01)

(52) U.S. Cl. ..... 174/110 R; 174/115; 174/116

(58) Field of Classification Search ..... 174/110 R, 174/113 R, 110 SC, 113 C, 115, 116
See application file for complete search history.

(56) References Cited

U.S. PATENT DOCUMENTS

| | | | | |
|---|---|---|---|---|
| 2,953,627 | A * | 9/1960 | Malneritch et al. | 174/102 R |
| 3,699,237 | A * | 10/1972 | Melia | 174/101.5 |
| 4,110,554 | A * | 8/1978 | Moore et al. | 174/101.5 |
| 4,654,476 | A | 3/1987 | Barnicol- et al. | 174/116 |
| 4,657,342 | A | 4/1987 | Bauer | 385/103 |
| 5,777,273 | A * | 7/1998 | Woody et al. | 174/113 R |
| 6,566,604 | B2 * | 5/2003 | Booth et al. | 174/110 R |
| 2003/0121694 | A1 | 7/2003 | Grogl et al. | 174/113 |

FOREIGN PATENT DOCUMENTS

| | | |
|---|---|---|
| DE | 1802444 | 6/1970 |
| DE | 3151234 | 6/1983 |
| DE | 3224597 | 12/1983 |
| DE | 3326986 | 2/1985 |
| DE | 3409871 | 9/1985 |
| DE | 69712814 T | 1/2003 |
| EP | 1041585 | 10/2000 |
| EP | 1863040 | 12/2007 |
| GB | 625613 | 6/1949 |
| GB | 3734020 | 4/1989 |
| GB | 2267778 | 12/1993 |

OTHER PUBLICATIONS

Search Report dated Jun. 14, 2008.

* cited by examiner

*Primary Examiner* — William Mayo, III
(74) *Attorney, Agent, or Firm* — Sofer & Haroun, LLP

(57) ABSTRACT

A flexible electric line for movable loads is specified which has at least two wires, in each case consisting of an electrical conductor and an insulation surrounding it, as stranded elements which are stranded around a core consisting of insulating material with dents extending in the longitudinal direction in which the stranded elements lie. In the core, a non-metallic tension- and compression-resistant carrier enclosed by a layer of insulating material is centrally arranged. The layer of insulating material consists of an impressible material remaining permanently elastic, which completely fills the internal interstices between the stranded elements, and it is surrounded by a sliding layer of a material having good sliding characteristics compared with the stranded elements.

7 Claims, 1 Drawing Sheet

FLEXIBLE ELECTRIC LINE

RELATED APPLICATION

This application claims the benefit of priority from German Patent Application No. 20 2007 012 165.2, filed on Aug. 31, 2007, the entirety of which is incorporated by reference.

FIELD OF THE INVENTION

The invention relates to a flexible electric line for movable loads, which has at least two wires, consisting in each case of an electric conductor and an insulation surrounding the latter, as stranded elements which are stranded around a core, consisting of insulating material, with dents extending in the longitudinal direction in which the stranded elements are lying and which are surrounded by a common jacket of insulating material (EP 1041585 B1).

BACKGROUND

Such lines are used, for example, for connecting movable devices to a voltage or signal source. Movable devices can be, for example, cranes, machine tools and robots. The lines must be capable of being loaded mechanically, with a flexural strength remaining uniform over a long period. They should also remain easily flexible within a wide temperature range which is, for example, between −40° C. and +80° C. If the lines are used, for example, as drag chain lines in automation technology, they must also survive without damage movements at increased speeds of up to 5 m/sec in the horizontal direction and corresponding accelerations of up to 50 m/sec$^2$ continuously even with relatively great lengths of up to 50 m. "Continuously" means, for example, up to 5 million bending cycles in this context.

The known line according to the EP 1041585 B1 initially mentioned is constructed as a flexible electric power line which has a central core around which power wires, at least one control line and at least one data line are stranded. The core has a central strength element consisting of plastic, over which a sheathing of a cross-linked material is provided in which an indentation extending over the entire axial length of the core is provided which is adapted for each stranded-around element to the contour of the latter. Apart from power and control commands, measurement data can also be transmitted, for example, by means of this electric power line. The good flexibility of the electric power line is supported by the special construction of the core, in the indentations of which adapted to the respective stranded-around element, these elements can slide when the electric power line is bending. This electric power line has been successful in practice. Measures of how a sliding mobility of the stranded elements relative to the core is to be achieved and whether a functional capability of the electric power line is to be maintained even with a great length during movements at high speed and acceleration are not mentioned in the document.

OBJECTS AND SUMMARY

The invention is based on the object of designing the line described initially in such a manner that it permanently retains its functional capability without damage even in the event of a relatively great length and movements at high speed and acceleration.

According to the invention, this object is achieved in that

- in the core, a non-metallic, tension- and compression-resistant carrier enclosed by a layer of insulating material is arranged,
- the layer of insulating material consists of an impressible material which permanently remains elastic and which completely fills the internal interstices between the stranded elements, and
- the layer of insulating material is surrounded by a sliding layer of material having good sliding characteristics compared with the stranded elements.

The essential element of this line is the elastically compressible core, coated to slide, which is constructed to be tension- and compression-resistant. This core has the result that the line, which is continuously moved, for example in a drag chain, withstands the permanently occurring tensile and compressive loads. Such tensile loads can exceed values from 15 N/mm$^2$ to 20 N/mm$^2$ in the acceleration phase of up to 50 m/sec$^2$ for a line arranged freely movably in a drag chain. During the delay phase of such a drag chain, compressor forces act on the line, the applicable values of which are analogous to the specified acceleration values. In addition, the core provides a permanent guarantee for the reversed bending strength of the line. The core, or the elastically compressible material of its layer of insulating material completely fills the inner interstices between the stranded elements, the stranded elements being pressed into it and lying in corresponding dents of the insulating material. This results in a stable guidance of the stranded elements and a compact structure of the line. Since, in addition, the stranded elements, because of the sliding layer of the core, can easily slide on it in the axial direction, mechanical damage to the core can be ruled out with a high degree of certainty even after many bending cycles.

BRIEF DESCRIPTION OF THE DRAWINGS

Illustrative embodiments of the subject matter of the invention are shown in the drawings, in which.

DETAILED DESCRIPTION

Figure 1:
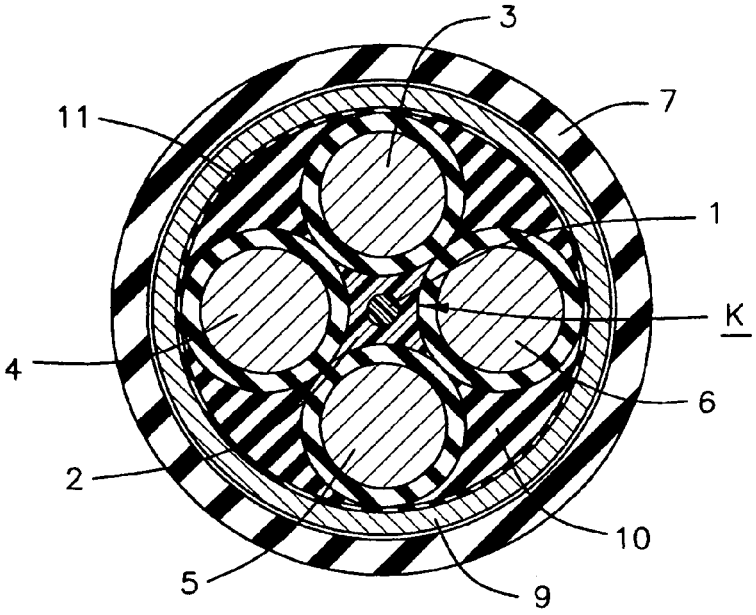
FIG. 1 shows a cross section of a line according to the invention.
Figure 3:
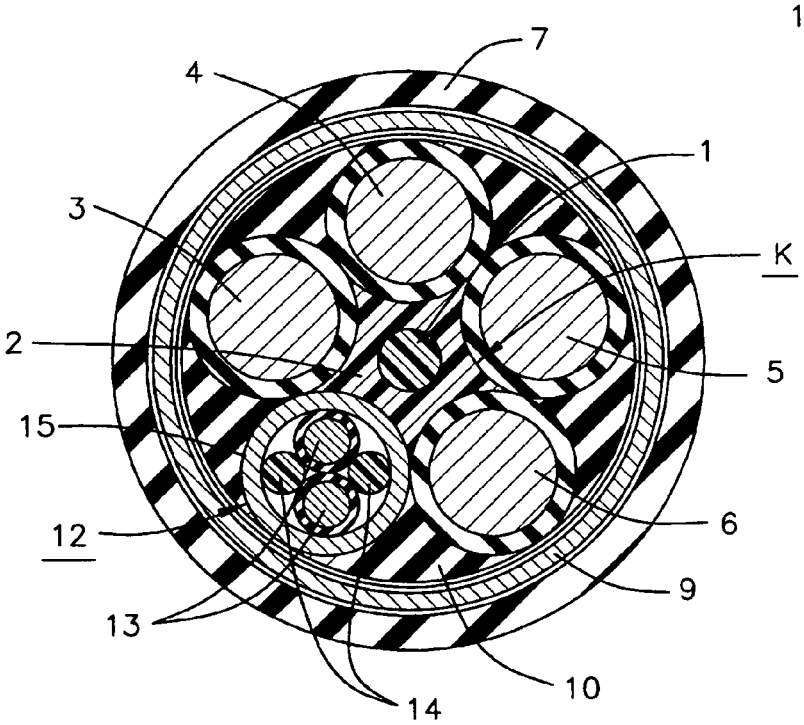
FIG. 3 shows a cross section of an embodiment of the line which is modified compared with FIG. 1.

FIG. 1 shows a flexible electric line which has a core K as the central element. The core K consists of a centrally arranged non-metallic, tension- and compression-resistant carrier 1 and a layer 2, surrounding it, of an elastically impressible insulating material which remains permanently elastic. Four wires 3, 4, 5 and 6 are stranded around the core K, of which the wires 3, 4 and 5 can be, for example, power wires and the wire 6 can be a protective conductor wire. In the text which follows, wires 3 to 6 will be called "stranded elements 3 to 6". Independently of other layers still to be explained, they are surrounded on the outside by a jacket 7 of insulating material which consists, for example, of polyurethane. The layer 2 of the core K is pressed in radially by the stranded elements 3 to 6 when they are stranded. In this process, dents are formed in the core K as is indicated in FIGS. 1 and 3. The dents extend helically in the axial direction of the line.

Figure 2:
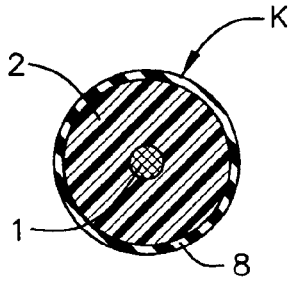
FIG. 2 shows a detail of the line in enlarged representation.

According to FIG. 2, the core K has in its original shape an approximately circular cross section. Depending on the type and structure of the stranded elements 3 to 6, however, it can also have another geometric shape, for example oval or rectangular. The layer 2 of the core K can advantageously consist of a soft gel-like thermoplastic elastomer (TPE-O) or of silicone or rubber, also in an expanded or cellular form.

The tension- and compression-resistant carrier 1 can advantageously consist of tension-resistant fibres of aramide, glass or basalt. To achieve the compression strength of the core K, the fibres are preferably completely embedded in a bonding agent, for example in a polyester resin. Such a tension- and compression-resistant carrier 1 has a modulus of elasticity of 50 000 N/mm$^2$ to 100 000 N/mm$^2$ and a tensile strength which is between 1000 N/mm$^2$ and 2000 N/mm$^2$.

The layer 2 of the core K is surrounded by a sliding layer 8, the material of which has good sliding characteristics compared with the stranded elements 3 to 6. Suitable materials for such a sliding layer 8 are materials based on polytetrafluoroethylene (PTFE). A corresponding material available in liquid form, which contains PTFE in nanoparticles, can be sprayed all around onto the layer 2, for example, or applied in an immersion process. The sliding layer 8 thus generated can then be thermally after-treated in a heating section equipped, for example, with infrared radiators. It adheres well to the layer 2 and has a thickness which is advantageously between 5 μm and 25 μm.

A foil of PTFE with a thickness of at least 25 μm can also be wound gaplessly around the layer 2 as sliding layer 8. Such a foil advantageously consists of expanded PTFE, preferably of an unsintered low-density PTFE.

The sliding layer 8 is constructed and arranged around the core K in such a manner that the elastic deformability of the layer 2 is not impaired. On the other hand, the sliding layer 8 can follow all changes in shape of the layer 2 of the core K without problems.

According to FIG. 1, the line according to the invention can also be equipped with an overall electrical shield 9 which is arranged over the core consisting of the stranded elements 3 to 6. Such an overall shield 9 can be constructed as braiding or peripheral stranding. To construct the shield, tinned copper wires can be used in conventional technique. With a particular advantage, however, wires having better elastic characteristics are used, however. Such wires are advantageously tinned or nickel-plated copper-plated steel wires or high-strength chromium nickel steel wires or tinned steel wires around which tinned copper strips are individually spun.

Appropriately, an essentially circular support area is created around the core of the line for the overall shield 9. For this purpose, an inside jacket 10 can be extruded around the stranded elements 3 to 6, around which a protective sheath 11 is moulded which is elastically compressible and advantageously consists of the same materials as the layer 2 of the core K. The protective sheath 11 is preferably surrounded by a thin sliding layer on which the overall shield 9 can easily slide when the line moves. It is advantageously constructed like the sliding layer 8 of the core K. Over the overall shield 9, the aforementioned jacket 7 is applied.

According to FIG. 3, the line according to the invention can be constructed, for example, as supply line for servo drives. Apart from the stranded elements 3 to 6 (wires 3 to 6) explained in conjunction with FIG. 1, such a line has as additional stranded element a shield signal line 12. The signal line 12 consists of two signal wires 13 which, together with two filling elements 14, are surrounded by an electrically active shield 15. The shield 15 is constructed, for example, as braiding or spun covering of tinned or silver-plated copper wires. Before applying the shield 15, a thin sliding layer of a material on which the shield 15 can easily slide is first suitably formed around the signal wires 13. With such a sliding layer, a foil of PTFE is preferably used which is gaplessly formed around the signal wires 13. An expanded unsintered low-density PTFE is particularly suitable. The signal line 12 is also pressed into the layer 2 of the core K. The remaining structure of the line according to FIG. 3 corresponds to the structure described for the line according to FIG. 1.

The invention claimed is:

1. Flexible electric line for movable loads comprising:

at least two conductors, each having an electric wire and an insulation surrounding the same, as stranded elements which are stranded around a core made of insulating material, the core having dents extending in the longitudinal direction in which the stranded elements are lying and which are surrounded by a common jacket of insulating material wherein a non-metallic, tension- and compression-resistant carrier, enclosed by a layer of insulating material, is centrally arranged in the core, the layer of insulating material is an impressible material remaining permanently elastic, which completely fills the internal interstices between the stranded elements, and the layer of insulating material is surrounded by a sliding layer of a material having good sliding characteristics compared with the stranded elements.

2. Cable according to claim 1, wherein the carrier is made of tension-resistant fibres which are completely embedded in a bonding agent, preferably in a polyester resin.

3. Cable according to claim 2, wherein the carrier is made of tension-resistant fibres which are completely embedded in a polyester resin.

4. Cable according to claim 1, wherein a material based on polytetrafluoroethylene is used for the sliding layer.

5. Cable according to claim 4, wherein the sliding layer is applied to the layer of insulating material by spraying or immersion with a layer thickness of at least 5 μm.

6. Cable according to claim 4, wherein a foil of polytetrafluoroethylene is formed gaplessly with a thickness of at least 25 μm around the layer of insulating material.

7. Cable according to claim 6, wherein the foil is expanded, unsintered low-density polytetrafluoroethylene.

* * * * *